United States Patent [19]

Lysenko et al.

[11] 4,210,350

[45] Jul. 1, 1980

[54] DOOR LATCH MECHANISM

[75] Inventors: George P. Lysenko; Richard J. Smith, both of Dubuque, Iowa

[73] Assignee: Deere & Company, Moline, Ill.

[21] Appl. No.: 926,554

[22] Filed: Jul. 20, 1978

[51] Int. Cl.[2] ..... E05C 19/06

[52] U.S. Cl. ..... 292/86

[58] Field of Search ..... 292/80, 84, 85, 86, 292/76, 77, 19, 20, DIG. 72

[56] References Cited

U.S. PATENT DOCUMENTS

| | | | |
|---|---|---|---|
| 398,981 | 3/1889 | Shaw | 292/80 |
| 542,753 | 7/1895 | Burton | 292/85 |
| 754,452 | 3/1904 | Howe | 292/76 X |
| 900,121 | 10/1908 | Pleins | 292/80 |
| 1,740,830 | 12/1929 | Parker | 292/80 X |
| 2,230,599 | 2/1941 | O'Connor | 292/19 |
| 2,707,311 | 5/1955 | Orlin | 292/80 X |
| 3,039,802 | 6/1962 | Barry | 292/85 |

FOREIGN PATENT DOCUMENTS

| | | | |
|---|---|---|---|
| 181866 | of 1917 | Canada | 292/80 |
| 686751 | 5/1964 | Canada | 292/76 |
| 971600 | 7/1975 | Canada | 292/76 |

*Primary Examiner*—Richard E. Moore

[57] ABSTRACT

An access door forms part of an enclosure and is releasably held in a closed position by means of a latch mechanism including a lock member formed of a spring metal strap bent to include a clip or hairpin portion having deflectable legs disposed in cooperating holding relationship to a catch member carried by the door when the latter is closed. The lock member also includes a deflectable mounting portion to which is connected a latch release lever for selectively deflecting the latter to disengage the deflectable legs thereof from the catch member to thereby release the door for movement to an open position.

6 Claims, 6 Drawing Figures

DOOR LATCH MECHANISM

BACKGROUND OF THE INVENTION

The present invention relates to door latch mechanisms and more specifically relates to latch mechanisms of doors of the type provided in vehicle compartments or enclosures for gaining access to fuel, oil or water fill spouts, for example.

Vehicles such as tractors and the like are often left unattended for relatively long periods of time in areas where it is difficult to maintain security and consequently the tractors are subject to acts of vandalism and theft. Accordingly, it is common practice to enclose various components of the vehicle and to provide lockable doors for gaining access to these components. The engines of these vehicles are among the components normally enclosed and to keep the doors within a manageable size some known vehicles have been provided with two or more doors adjacent to one another. In such multiple door arrangements, it is known to provide one of the doors with means for permitting it to be secured from the outside by installation of a padlock or to be locked by use of a key while the remaining door or doors are provided with a latch mechanism which is releasable only from the inside of the enclosure. The present invention is directed to such a latch mechanism.

Heretofore such latch mechanisms have not been entirely satisfactory due to their relative complexity.

SUMMARY OF THE INVENTION

According to the present invention, there is provided a novel door latch mechanism for releasably securing an access door in its closed position.

An object of the invention is to provide a door latch mechanism which is of simple construction.

A more specific object of the invention is to provide a door latch mechanism comprising only three components.

Another object of the invention is to provide a door latch mechanism wherein a spring metal strap is configured to form a lock member which yieldably resists deformation to a release position.

Yet another object is to provide a lock member, as described in the foregoing object, which acts upon its release from a catch carried by the door, to displace the door from its closed position so as to permit an edge thereof to be grasped by an operator's hand.

These and other objects will become apparent from a reading of the ensuing description together with the appended drawings.

DESCRIPTION OF THE PREFERRED EMBODIMENT

Figure 1:
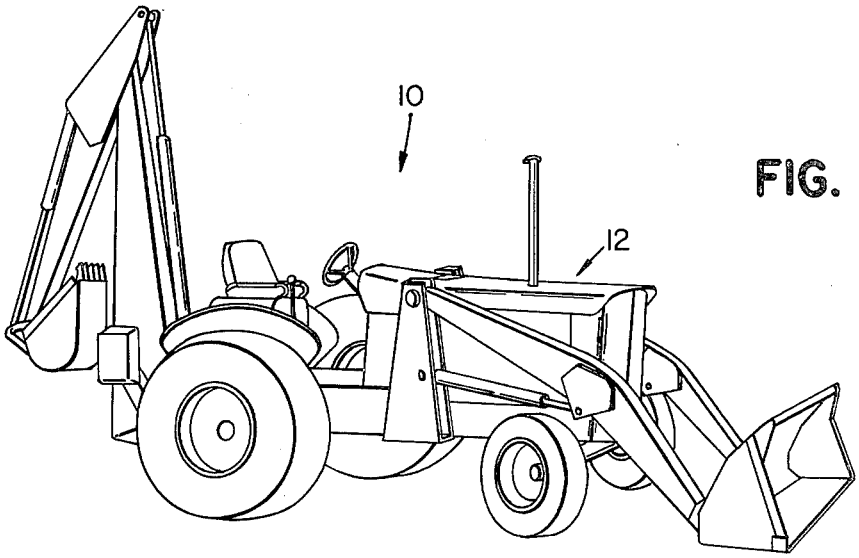
FIG. 1 is a perspective view of a vehicle representative of one type with which the present invention is adapted for use.
Figure 2:
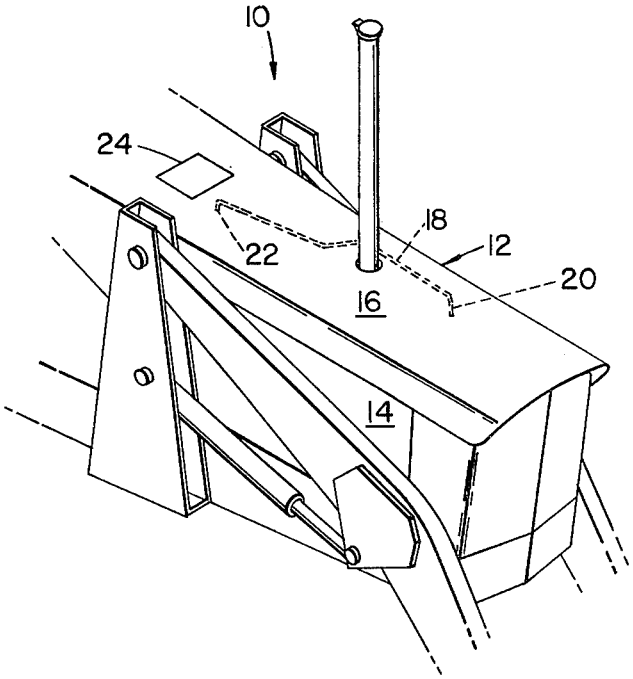
FIG. 2 is an enlarged perspective view of a portion of the engine enclosure of the vehicle shown in FIG. 1.

Referring now to FIGS. 1 and 2, therein is shown a vehicle 10 commonly known as a backhoe loader. It is to be understood that the vehicle 10 is only one of many types of vehicles with which the present invention is adapted for use.

The vehicle 10 includes an engine enclosure or compartment 12 including opposite side panels 14 (only one shown) which may be releasably secured in place by any conventional means including a key-lockable lock or by a plurality of cap screws, for example. Extending fore-and-aft beneath a top wall 16 of the enclosure 12 is a latch release actuator 18 formed from a rod having its forward end 20 located such that access thereto may be accomplished only by removing the left one of the side panels 14. The actuator 18 has a rearward end 22 attached to a latch mechanism, described herein below, for releasably holding an access door 24 in its closed position.

Specifically, referring now to FIGS. 3–6, it can be seen that the access door 24 is shaped complementary to and located within a generally rectangular opening 26 provided in the top wall 16 of the enclosure 12 for gaining access to a fuel cap 28 closing a fill spout 30. The door 24 is hingedly supported from the wall 16 by means of a transverse hinge rod 32 received in central hinge brackets 34 riveted in transverse alignment to the underside of the door 24 at a location spaced forwardly from a rear edge 36 of the door 24 and end hinge brackets 38 having the opposite ends of the rod 28 received therein and being riveted to the underside of the wall 16 at opposite sides of the opening 26. The opposite ends of the rod 32 are upset, as at 39, to hold the rod in place.

Figure 3:
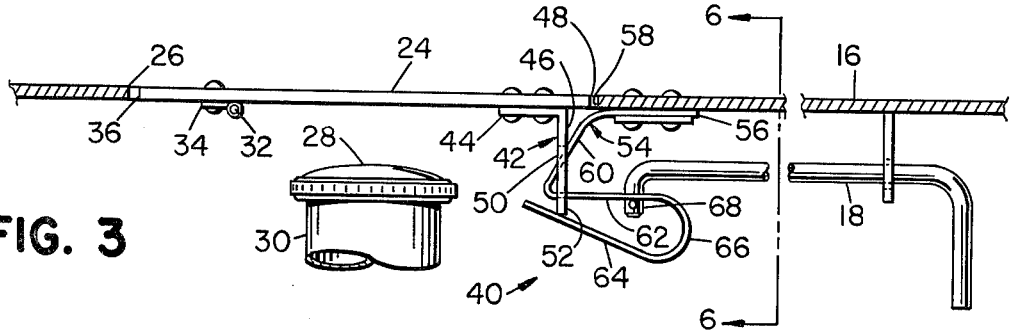
FIG. 3 is a vertical sectional view taken through the engine enclosure at the right side of an access door shown latched in a closed position by a latch mechanism constructed according to the principles of the present invention.
Figure 4:
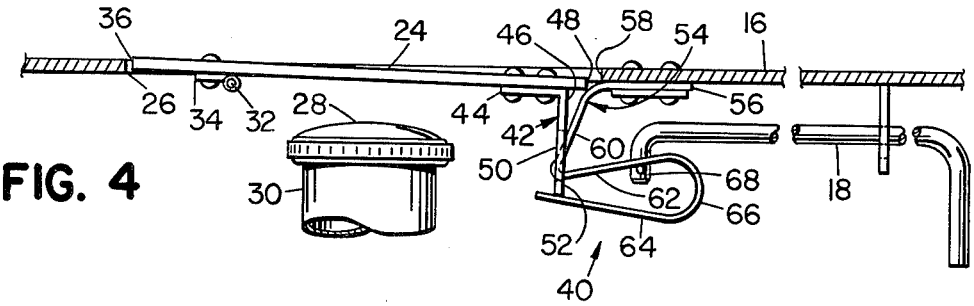
FIG. 4 is a view similar to FIG. 3 but showing the lock member deflected to a position wherein it is just about to release the catch member.

A latch mechanism 40 is provided for releasably retaining the door 24 in a closed position, as shown in FIG. 3, wherein it occupies the opening 26 such as to prevent access to the fuel cap 28. Specifically, the latch mechanism 40 includes a catch member 42 formed of a rectangular strap bent to form a pair of legs 44 and 46 extending at right angles to each other, with the leg 44 being riveted to the underside of the door 24 at a location just rearwardly of a forward edge 48 of the door 24 and with the leg 46 depending vertically from the door. A rectangular opening 50 is located in the leg 46 and that part of the leg 46 bordering the bottom of the opening defines a lock-grippable portion 52.

The lock mechanism 40 further includes a lock member 54 formed of specially bent spring metal strap. Specifically, the member 54 includes an upper horizontal mounting portion 56 riveted to the underside of the wall 16 adjacent a forward edge 58 of the opening 26, a fore-and-aft deflectable portion 60 joined to the rearward end of and inclined downwardly and rearwardly from the mounting portion 56 and a rearwardly opening fore-and-aft extending clip or hairpin portion having an upper leg 62 joined at its rear end to the lower end of the deflectable portion 58 and having its forward end joined to the forward end of a lower leg 64 by an arcuate bight portion 66 which biases respective rearward end portions of the legs towards engagement with each other. For a purpose hereinafter described, the lower leg 64 is longer than the upper leg 62.

Figure 5:
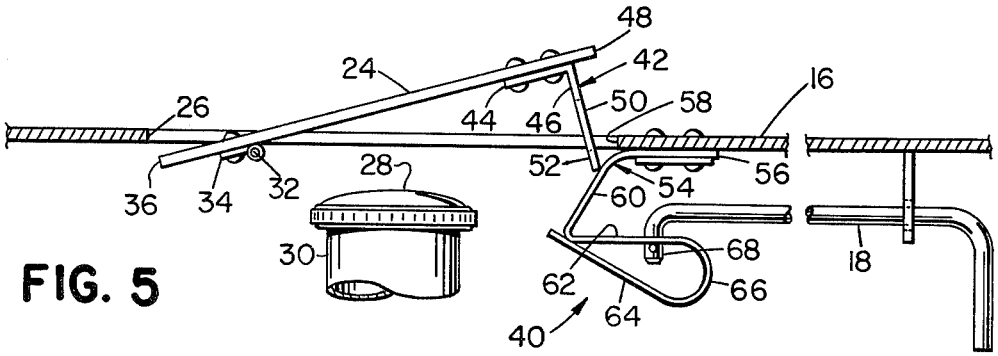
FIG. 5 is a side view of FIG. 3 but showing the door released from the latch mechanism.
Figure 6:
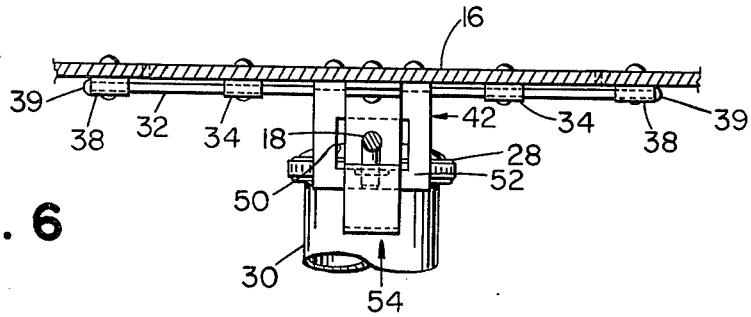
FIG. 6 is a vertical sectional view taken along the line 6—6 of FIG. 3.

When the lock mechanism 40 is in a door-lock position, as illustrated in FIG. 3, the rearward ends of the legs 62 and 64 of the hairpin portion are disposed in gripping relationship to the catch portion 52 of the catch member 42. The latch release actuator 18 is connected to the lock member 54 for selectively releasing the latter from the portion 52 and for this purpose has a downturned end 68 received in a hole provided in the upper leg 62 of the hairpin portion of the lock member 54. Thus, it will be appreciated that upon the lever 18 being pulled forwardly, the deflectable portion 58 will be deflected forwardly and when it has been fully deflected to a position just forwardly of an intermediate position shown in FIG. 4, the upper leg 62 of the hairpin portion will move free of the catch portion 52 and at the same time the lower leg 64 of the hairpin portion will move into engagement with the upper leg 62 and carry the catch member 42 therewith to effect an initial raising of the door 24. Then upon the lever 18 being released, the deflected portion 58 will return to its free state and while doing so will urge the member 42 upwardly to elevate the forward edge 48 of the door 24 to a partially open position, as shown in FIG. 5, wherein the door can easily be grasped and fully opened by an operator.

It will be appreciated that the door 24 may be returned to its locked position, shown in FIG. 3, by first returning it to its released position (FIG. 5) and then pressing downwardly thereon to first effect forward deflection of the portion 58 of the lock member 54 and then to deflect the lower leg 64 away from the upper leg 62 of the hairpin portion a distance sufficient for permitting the catch member portion 52 to move therebetween.

We claim:

1. In combination with an enclosure having a wall provided with an access opening and a door having a hinge connection adjacent one edge thereof connecting the door to the wall for movement between a closed position wherein it blocks access through the opening and an open position wherein it is pivoted relative to the opening for permitting access therethrough, and a latch mechanism including a catch member mounted on the door adjacent a second edge opposite from the one edge and a lock member mounted on the wall for releasable engagement with the catch member; the improvement residing in the latch mechanism and comprising: said catch member including a catch portion disposed in spaced parallel relationship to the door; said lock member being in the form of a spring metal strap having a clip portion formed at one end thereof and including a pair of resiliently separable legs disposed in gripping engagement with the catch portion, when the door is in its closed position, an intermediate deflectable portion joined to the clip portion and a mounting portion joined to the intermediate portion and secured to the wall at a location adjacent the catch member when the door is in its closed position; and a lock member release actuator connected to the clip portion and operable for pulling on the latter to effect deflection of the deflectable portion and withdrawal of the separable legs from the catch portion of the latch member to thereby release the door.

2. The latch mechansim of the combination defined in claim 1 wherein the catch member is in the form of a strap bent to have first and second legs cooperating to define an included angle of approximately 90°; said first leg of the catch member being secured to the door; said second leg of the catch member having an opening therein bordered by said catch portion; and one leg of said clip portion and said deflectable portion each being partially received within said opening when the door is in its closed position.

3. The latch mechanism of the combination defined in claim 1 wherein the mounting portion and a first leg of the clip portion are generally parallel to each other and to the wall and the deflectable and mounting portions cooperate to define an included obtuse angle with the deflectable portion interposed between the door and catch portion when the door is in its closed position and the clip portion is fully-engaged with the catch portion.

4. The latch mechanism of the combination defined in claim 3 wherein a second leg of the clip portion is longer than the first leg and remains in engagement with the catch portion after the deflectable portion has been fully deflected to release the catch portion from being held between the first and second legs of the clip portion whereby upon full deflection of the deflectable portion the second leg will move into engagement with the first leg and at the same time act against the catch member to move the latter into engagement with an end of the deflectable portion whereupon release of the deflectable portion will result in the latter acting as a cam against the catch member to effect partial opening of the door.

5. In an enclosure including an access opening, a door shaped complementary to the opening and a hinge connection joining the door to the remainder of the enclosure for movement between a closed position wherein it is located in the opening and blocks access to the inside of the enclosure by way of the opening and an open position wherein it is pivoted away from the opening to permit access therethrough and a latch mechanism for releasably holding the door in its closed position, the improvement residing in said latch mechanism and comprising: a catch member fixed to an inner surface of the door adjacent a peripheral portion thereof opposite from the hinge connection and including a catch portion spaced from and generally paralleling the door; a lock member in the form of a spring metal strap having a mounting portion fixed to the enclosure so as to be adjacent the catch member when the door is in its closed position; said strap further including a deflectable portion joined to the mounting portion and a reversely bent portion joined to the deflectable portion and including a pair of legs disposed in resilient gripping relationship to the catch portion when the door is in its closed position; and a release actuator connected to the reversely bent portion for selectively pulling the latter from engagement with the catch portion to release the access door.

6. In an enclosure including a main portion provided with an access opening, a door supported from the main portion by a hinge connection located adjacent one side of the opening and establishing a pivot axis about which the door is swingable between open and closed positions respectively wherein it permits and blocks access to the interior of the enclosure by way of the opening, and a latch mechanism including a lock member fixed to an inner surface of the main portion at a location adjacent a second side of the opening which is opposite from the one side and a catch member fixed to an inner surface of the door and including a catch portion spaced from the door and positioned for releasable reception in the lock member, the improvement residing in the latch mechanism and comprising: said lock member being defined by a spring metal strap including a hairpin portion having a pair of deflectable legs receiving the catch portion of the catch member therebetween when the door is in its closed position; said strap further including an end portion fixed to the main portion of the enclosure and joined to one of the legs of the hairpin section by a deflectable portion extending generally orthogonally to the hairpin portion; and a release actuator connected to the hairpin portion for selectively pulling the same away from the catch portion to release the access door.

* * * * *